United States Patent [19]

Hock

[11] 4,261,605

[45] Apr. 14, 1981

[54] LATCHING MECHANISM

[76] Inventor: Lester R. Hock, 2484 N. Forbes Ave., Claremont, Calif. 91711

[21] Appl. No.: 42,321

[22] Filed: May 25, 1979

[51] Int. Cl.[3] ..... E05C 3/14

[52] U.S. Cl. ..... 292/228; 49/394

[58] Field of Search ..... 49/394; 292/228, 202

[56] References Cited

U.S. PATENT DOCUMENTS

| | | | |
|---|---|---|---|
| 715,217 | 12/1902 | Sieffert | 292/228 |
| 2,775,111 | 12/1956 | Savage | 292/228 |
| 3,161,923 | 12/1964 | Crain | 292/228 X |
| 3,220,759 | 11/1965 | Miller | 292/228 X |

*Primary Examiner*—Kenneth Downey

*Attorney, Agent, or Firm*—Blakely, Sokoloff, Taylor & Zafman

[57] ABSTRACT

An apparatus for releasably maintaining the door of a cabinet in the closed position. The apparatus is comprised of a strike and a latch member which are releasably engageable. The latch is rotatably mounted and spring biased towards the strike. The apparatus has substantially smooth surfaces and is made of non-porous metal so as to resist capturing deposits of dirt and food. The apparatus is configured to be easily opened and to be free of crevices or pockets to prevent the accumulation of dirt and debris. In operation, the latch member is released from engagement with the strike upon being struck on its upper surface.

1 Claim, 5 Drawing Figures

LATCHING MECHANISM

BACKGROUND OF THE INVENTION

1. Field of the Invention

This invention relates to a latching mechanism for cabinets and, in particular, cabinets used in the storage, warming and preparation of food.

2. Prior Art

Cabinets and the like are, of course, common in food preparation facilities such as kitchens in airplanes, restaurants and fast food establishments. Cabinets and cabinet-like structures are used as cupboards, refrigerators and food warming cabinets. Foods in partially prepared and fully prepared states are constantly being brought in and out of such cabinets. The doors of such cabinets are typically kept in a releasably closed position by latching means, magnetic means or mechanical biasing means. These doors are opened by the manual grasping of a handle, an indentation in the door, or some manual grasping aperture.

Because the prior art cabinets typically require that at least one hand be free in order to open them, the placement of food, which is often contained in bulky and inconvenient carriers, proves to be very difficult. The food is either first set aside while the door is opened or the person placing the food in the carrier must perform a precarious balancing act, that is, placing the bulky food container in one of his hands while opening the cabinet door with his other hand.

A problem of greater consequence involves the cleanliness of the cabinet and its surfaces. The handle means or indentations usually employed tend to form pockets or crevices where dirt and debris accumulate. In the handling and preparation of food, the food preparer and his aids more often than not have remnants of food on their hands when they open up the cabinet doors in placing or removing food therefrom. These remnants collect in the crevices or pockets and, because of their inaccessibility, are difficult to remove during normal cleaning processes. When these food remnants and other debris are exposed to room temperature, bacteria and other micro-organisms thrive in the debris which has accumulated. All too frequently, such bacteria and other micro-organisms are transferred to otherwise untainted food in various stages of preparation. The spoilation of food is accelerated and concurrently so is the build-up of foul odors. Because of the variety of foods which are handled by a food preparer and his staff, the growth of undesirable micro-organisms is enhanced.

As a consequence of the creation of environments favorable to the growth of harmful micro-organisms by the crevices and pockets typically associated with currently used handle means for cabinets, food poisoning and similar ailments may strike consumers. This problem, as well as the accelerated spoilage problem discussed above, can prove fatal to a commercial food preparation establishment.

SUMMARY OF THE INVENTION

Accordingly, it is the object of this invention to provide a mechanism for releasably maintaining the door of a cabinet in the closed position, which is resistent to the formation of pockets or crevices or the like in which dirt and debris may accumulate.

It is a further object of this invention to provide a latching mechanism for a cabinet which is resistent to the collection of debris in which bacteria and other harmful micro-organisms may grow.

It is a further object of this invention to provide a latching mechanism which may be easily cleaned and thoroughly sanitized.

It is a still further object of the present invention to provide a latching mechanism which is easily and conveniently disengageable.

These objects and others are accomplished by the present invention which is a latching mechanism comprising a strike and a latching member which are releasably engageable. The strike and the latching member are attached to adjacent surfaces of the cabinet's body panel and the cabinet's door edge. The latch member is mounted so that it may rotate through a predetermined arc about an axis which is parallel to the line formed at the junction of the two surfaces to which the latching mechanism is attached when the door is closed. The latching member is urged by a spring means towards the direction that would accomplish engagement of the latching member and the strike. The latching member is configured so that a slight pressure in opposition to the spring supplied bias allows for the disengagement of the latching mechanism. This pressure can be caused by the slapping contact of a hand against a latching member or the similar contact by an elbow or a shoulder. The exposed surfaces of the latching member are all smooth so that there are no pockets or crevices in which food particles may accumulate. The latching mechanism is configured so that any food which may be deposited upon the latching mechanism during storage and retrieval of food by a food preparer can be easily and completely removed with a simple wiping motion.

The objects described above and other objects and advantages of the present invention will become apparent from the following disclosure and the accompanying drawings.

DETAILED DESCRIPTION OF THE INVENTION

Figure 1:
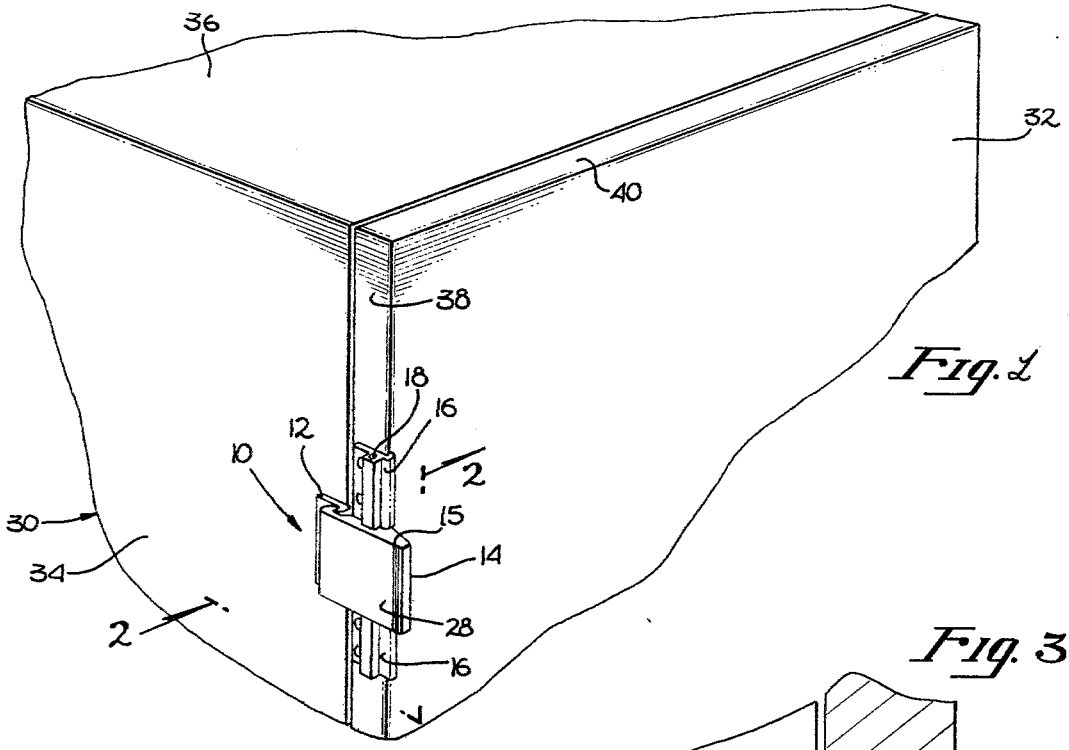
FIG. 1 is a perspective view of the present invention mounted on the side edge of a door and the panel of the cabinet adjacent that side edge.

In the following discussion, the same reference numeral will designate like elements throughout.

Figure 3:
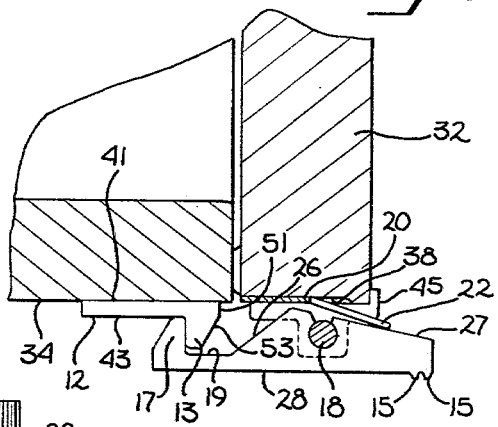
FIG. 3 is a side view of the present invention in the engaged position taken along line 3—3 of FIG. 2.

Referring to FIG. 1, the latching mechanism of the present invention is generally designated by the numeral 10. The latching mechanism is designed to releasably maintain door 32 in a closed position against the body of cabinet 30. The latching mechanism is comprised of a strike 12, latch member 14, butt members 16 and pin 18. As shown in FIG. 3, the latching mechanism also comprises leaf spring 20. The latching mechanism is mounted on an edge surface of the door 32 and adjacent body panel 34 of cabinet 30. Here, the latching mechanism of the present invention is mounted on edge surface 38 and is adjacent body panel 34. However, the latching mechanism could just as well have been mounted on edge surface 40 and panel 36. In the embodiment shown, strike 12 is mounted on panel 34, while butt members 16, wherein pin 18 is received and upon which latch member 14 is rotatably mounted, are mounted on edge surface 38. The positions of the strike and the butt members, etc., could very well have been reversed.

Figure 2:
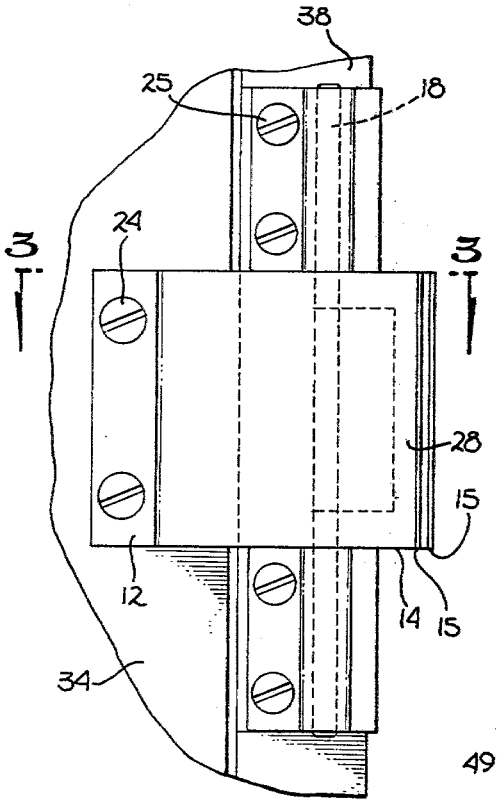
FIG. 2 is a plan view of the present invention taken along line 2—2 of FIG. 1.
Figure 4:
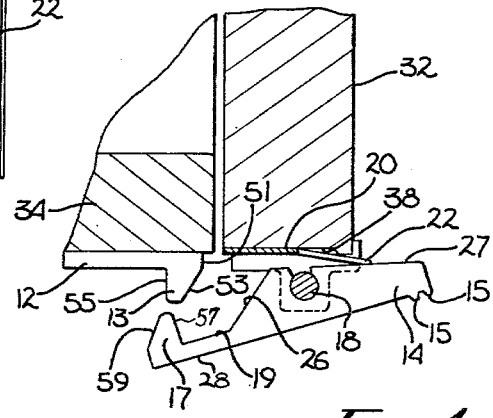
FIG. 4 illustrates the present invention as shown in FIG. 3, but in the disengaged position.

Referring to FIG. 2, strike 12 and butt members 16 are mounted on the panel and the edge surface, respectively, by means of screws 24 and 25. Butt members 16 have a channel within them to receive pin 18. The butt members are mounted so that the channels which run through them are parallel to the junction line formed by the junction of the door and the body panel of the cabinet in the area of the latching mechanism. Pin 18 generally has a circular cross-section, as can be seen in FIGS. 3 and 4, to allow the rotation of latch member 14 which is mounted thereon between the butt members. To accommodate the mounting upon and rotation about pin 18, the latch member also has a channel in it of circular cross-section. While, as mentioned above, the pin has a generally circular cross-section, one of its ends will be slightly enlarged or have a slightly distorted cross-section so that that end can be press-fit into one of the butt members. In commercial embodiments, the pin, the latch member and both butt members may be fabricated as an integral unit with the latch member premounted on the pin, the pin having both of its ends distorted, and with both butt members press-fit thereover.

With numeral 41 designating the bottom surface of strike 12 and numeral 43 designating its top surface, as shown in FIG. 3, and with pin 18 extending in the longitudinal direction, directional orientation with respect to the elements of the present invention is defined. The bottom surface of the strike is mounted against panel 34 with its side 51 formed at its end adjacent the junction between the door and the panel. Extending upwards from the top surface of the strike and at side 51 is lip 13. This lip runs longitudinally along side 51 and has a front surface 53 which extends upwards and outwards from side 51. The lip is further defined by its back surface 55 (see FIG. 4) which extends up from top surface 43 and is perpendicular to the bottom surface 41. Thus, when viewed from its side, the lip appears to have the shape of a triangle with one of its sides, that is, the front surface, facing outwardly and upwardly therefrom.

Latch member 14, which along with the assembly comprising the pin 18 and butt members 16 is mounted upon edge surface 38, has an upper surface 28 and a lower surface comprising first incline 26, second incline 27 and groove 19. In the preferred embodiment, the channel of the latch member in which the pin is received partially opens up onto second incline 27. Extending downward from the latch member at its end which is closest to panel 34 is lip 17, denominated as the second lip, which is very much similar in appearance to first lip 13. This lip has an outwardly and downwardly facing impact surface 59 and a rear surface 57 which, when door 32 is in the closed position and latch member 14 is in the engaged position, is perpendicular to bottom surface 41 of the strike 12. Thus, the second lip, when viewed in cross-section, has a triangular appearance too. Groove 19 is shaped out of the lower surface of the latch member so that first lip 13 can be received therein when the latch member is in the engaged position.

Figure 5:
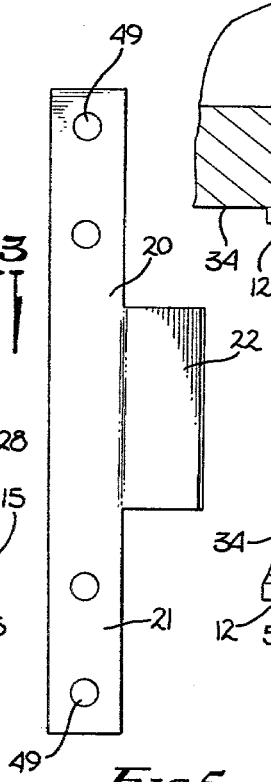
FIG. 5 is a plan view of the leaf spring used in the preferred embodiment of the present invention.

The latch member is urged to rotate towards the engaged position so that it will remain in that position unless intentionally removed therefrom. The bias necessary to achieve this condition is provided by leaf spring 20. As seen in FIG. 5, the leaf spring 20 is made up of plate 21 and bias member 22. Prior to mounting butt members 16, the leaf spring is placed underneath them with holes 49 disposed so that screws 25 will pass through them into edge surface 38. Bias member 22 pushes up against second incline 27 of the lower surface of the latch member thereby providing the necessary force to urge the latch member towards the engaged position. (See FIGS. 3 and 4.) In the commercial embodiment discussed earlier, leaf spring 20 may be included with the butt members, the pin and the latch member in a single assembly.

In operation, latch member 14 is released from engagement with strike 12 by the application of pressure on top surface 28 at the end of the latch member opposite from second lip 17. This counteracts the pressure applied by leaf spring 20 and allows the latch member to rotate upwards so that there is clearance between the two lips 13 and 17, respectively, as shown in FIG. 4. When this occurs, door 32 may be swung open and will do so automatically if it is spring loaded or otherwise mechanically biased towards the open position.

Inclines 26 and 27 are configured to define the arc through which latch member 14 may rotate. Thus, second incline 27 slopes upwards towards upper surface 28 at a sharp enough angle, that is, it is sufficiently recessed, to allow sufficient upward rotation of the latch member so that second lip 17 can clear first lip 13 when such lips are in vertical alignment. First incline 26, which slopes upwards until it meets groove 19, is set at an angle so that the downward rotation of the latch member, that is, with second lip 17 moving in the downward direction, is limited so that latch member 14 cannot be urged to rotate so far in that direction by the leaf spring 20 that the upper edge of impact surface 59 of the second lip is lower than the bottom edge of front surface 53 of the strike when door 32 is being closed and the latch member is approaching said strike. The downward rotation of the latch member can also be limited by extending second incline 27 back towards the second lip side of the latch member past the axis about which the latch member rotates, as shown in FIG. 3. Thus, the lowest edge of incline 27, instead of incline 26, will abut plate 21 of leaf spring 20 to stop such downward rotation.

In operation, when door 32 is open, latch member 14 is rotated downward to a limited extent. As the doors closed, impact surface 59 will collide with front surface 53 of the strike. Second lip 17 will rebound upwards from such collision and will clear the upper edge of front surface 53. As the momentum of the door continues forward, second lip 17 will pass by first lip 13 and will be rotated downwards by the leaf spring 20. This downward rotation will cease when the upper edge of the impact surface 59 comes into contact with the top surface 43 of the strike. Rear surface 57 of the second lip and back surface 55 of the first lip will be in face-to-face relation and the first lip will be captured within the groove 19 of the latch member. The latch mechanism will remain in this engaged position until removed therefrom by the intentional application of pressure on upper surface 28 towards the end disposed opposite from the second lip. It is to be noted here that in the event that door 32 is not closing at a fast rate so that the upward momentum imparted to second lip 17 is insufficient to make it bounce above the first lip, front surface 53 and impact surface 59 are set at such angles to the vertical that the impact surface may slide upwards along the front surface until the second lip has slid over and past the first lip. This upward sliding movement is facilitated by setting the angles at which the front surface and the impact surface diverge from vertical equal to each other. Best results are achieved when such angles are 45° each.

Because the present invention is particularly intended for cabinets used in food preparation facilities, it is anticipated that food debris and greasy substances will be deposited upon the latch member. Thus, the latch member will become slippery to the touch when pressure is being applied to it to disengage the latching mechanism, particularly when such pressure is being applied by a greasy or otherwise wet hand. In order to provide a surface against which positive contact can be made, that is, in order to prevent the user's hand from slipping off the latch member without causing the latching mechanism to disengage, ridges 15 longitudinally extend upwards from the otherwise flat surface 28 from the end of the latch member where the disengaging pressure is to be applied. (See FIGS. 2 and 3.)

It is well-known that bacteria and other harmful micro-organisms will thrive wherever food debris and other deposits accumulate. Because the food preparer will be interchangeably handling the latch member and food, if such debris were allowed to accumulate on the latching mechanism, harmful micro-organisms would be transferred to the food causing it to spoil at a faster rate and causing harmful substances to be ingested when the food is consumed. Therefore, it is a feature of the present invention that the latching mechanism is very easily cleaned and sanitized. The exposed surfaces of the latching member are all smooth and devoid of pockets or crevices in which food debris or other unwanted deposits can accumulate. To completely clean the latching mechanism, all that is required is a wiping motion. To sanitize it, all that is needed is the application of a disinfectant. To further prevent the accumulation of unwanted deposits (such deposits more often than not will come from the hands of the users of the cabinet) the components of the latching mechanism and, in particular, the strike, the latch member and the butt members, are made of a non-porous material. Metals such as brass or steel could be used. It has been found that having the elements of the latch mechanism formed of extruded aluminum is preferred, extruded aluminum providing ease of manufacture and excellent results during use.

In the preferred embodiment, butt members 16 will be made with overhang 45 longitudinally extending downwards from the side of the butt member intended to be adjacent the outside corner of edge surface 38 when said butt members are mounted thereon. (See FIG. 3.) This overhang facilitates alignment of the butt members so that pin 18 contained therein is parallel to the junction line formed between the junction of the door and panel 34. In turn, this helps insure the proper alignment of the second lip of the latch member with the first lip of the strike.

In the above description, the invention has been disclosed by way of example and by discussion of the preferred embodiment. However, it is clear that variations and modifications may be made without departing from the invention disclosed herein.

I claim:

1. An apparatus for releasably maintaining a door of a cabinet in a closed position, said apparatus being mounted upon a first edge surface of said door and upon the panel of said cabinet which is adjacent said first edge surface when said door is in said closed position, said apparatus comprising:

(a) a strike which is mounted on one of said first edge surface and said panel, the bottom surface of said strike contacting the one of said first edge surface and said panel upon which said strike is mounted, said strike having a side adjacent and parallel to the junction line formed by the junction of said first edge surface and said panel, said junction line defining the longitudinal direction in said strike, said strike having a first lip at said side longitudinally extending upwards from the top surface of said first lip, the front surface of said first lip facing outwards from said strike, the back surface of said first lip being substantially perpendicular to said bottom surface, said front surface and said back surface defining the sides of a first acute angle;

(b) a pin of generally circular cross-section;

(c) at least one butt member mounted on the other of said first edge surface and said panel than the said one that said strike is mounted upon, said butt member having a first channel in it to receive a portion of said pin, said channel running parallel to said junction line and defining the longitudinal direction in said at least one butt member;

(d) a latch member having a second channel of circular cross-section to receive said pin, said second channel defining the longitudinal axis of said latch member, said latch member being rotatably mounted on said pin, said latch member having an upper surface and a lower surface, said lower surface generally facing the one of said edge surface and said panel on which said at least one butt member is mounted, said latch member having a second lip longitudinally extending downwards from said lower surface, said second lip having an impact surface which faces outwards from said latch and towards said front surface of said strike when said door is partially open, the rear surface of said second lip being substantially perpendicular to said bottom surface of said strike when said door is in said closed position and said latch member is in engaged relation with said strike, said impact surface and said rear surface defining the sides of a second acute angle, said latch member having a longitudinally running groove in said lower surface adjacent said rear surface, said groove adapted to substantially receive said first lip of said strike when said latch member and said strike are engaged, said back surface and said rear surface being in face-to-face, abutting relation when said door is in the closed position with said strike and latch member engaged, said lower surface having a first incline sloping upwards towards said groove in one direction and a second incline sloping upwards in the other direction towards the end of said latch member oppositely disposed from said second lip, said first incline and said second incline forming a vertex approximately along the longitudinally extending center line of said lower surface, the shape of said lower surface acting to define the range of angular orientations said latch member may rotate through, such that the limit of rotation in the direction towards which said second lip extends is such that the upper edge of said impact surface is above the lower edge of said front surface of said strike as said strike and said latch member approach each other when said door is moving from the open to the closed position, and whereby the limit of rotation in the opposite direction from that in which said second lip extends is such that the lower edge of said impact surface at least clears the upper edge of said front surface when said second lip is directly above said first lip; and (e) spring means urging said latch member to rotate in the direction towards which said second lip extends, said at least one butt member, said strike, said at least one butt member and said latch member of said apparatus having exposed surfaces which are smooth, hard and evenly contoured;

whereby food, dirt and other debris are excluded from absorption, adsorption or collection upon said apparatus and whereby any such food, dirt and other debris deposited thereon may be completely removed by wiping action.

* * * * *